US010992057B2

(12) United States Patent
Avser et al.

(10) Patent No.: US 10,992,057 B2
(45) Date of Patent: Apr. 27, 2021

(54) ELECTRONIC DEVICE HAVING DUAL-BAND ANTENNAS MOUNTED AGAINST A DIELECTRIC LAYER

(71) Applicant: Apple Inc., Cupertino, CA (US)

(72) Inventors: Bilgehan Avser, Mountain View, CA (US); Harish Rajagopalan, San Jose, CA (US); Simone Paulotto, Redwood City, CA (US); Jennifer M. Edwards, San Francisco, CA (US); Hao Xu, Cupertino, CA (US); Rodney A. Gomez Angulo, Santa Clara, CA (US); Matthew A. Mow, Los Altos, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 345 days.

(21) Appl. No.: 16/146,649

(22) Filed: Sep. 28, 2018

(65) Prior Publication Data

US 2020/0106192 A1 Apr. 2, 2020

(51) Int. Cl.
*H01Q 1/38* (2006.01)
*H01Q 21/06* (2006.01)
(Continued)

(52) U.S. Cl.
CPC ..... *H01Q 21/065* (2013.01); *H01Q 1/38* (2013.01); *H01Q 5/28* (2015.01); *H01Q 5/357* (2015.01); *H01Q 21/064* (2013.01)

(58) Field of Classification Search
CPC ..... H01G 21/065; H01G 5/28; H01G 5/357; H01G 1/38; H01G 21/064
See application file for complete search history.

(56) References Cited

U.S. PATENT DOCUMENTS 7,595,759 B2 9/2009 Schlub et al.
8,102,330 B1 1/2012 Albers
(Continued)

FOREIGN PATENT DOCUMENTS

JP 2017085289 A 5/2017
KR 101014347 B1 2/2011

OTHER PUBLICATIONS

Dhakad, Shailendra Kumar, et al.,"Slotted Microstrip Patch Antenna for Dual Band and UWB Applications", Proceedings of the Sixth International Conference on Computer and Communication Technology 2015. ACM, 2015.

(Continued)

*Primary Examiner* — Graham P Smith
(74) *Attorney, Agent, or Firm* — Treyz Law Group, P.C.; Michael H. Lyons

(57) ABSTRACT

An electronic device may be provided with a cover layer and a phased antenna array mounted against the cover layer. Each antenna in the array may include a first patch element that is directly fed using first and second feeds and a second patch element that is directly fed using third and fourth feeds. A slot element may be formed in the first patch element. The first patch element may radiate in a first frequency band through the cover layer. The slot element may radiate in a second frequency band that is higher than the first frequency band through the cover layer. The second patch element may indirectly feed the slot element. Locating the radiating elements for each frequency band in the same plane may allow the antenna to radiate through the cover layer in both frequency bands with satisfactory antenna efficiency.

20 Claims, 10 Drawing Sheets

(51) Int. Cl.
*H01Q 5/357* (2015.01)
*H01Q 5/28* (2015.01)

(56) References Cited

U.S. PATENT DOCUMENTS

| | | | |
|---|---|---|---|
| 8,818,457 | B2 | 8/2014 | Besoli et al. |
| 9,865,935 | B2 | 1/2018 | Miraftab et al. |
| 10,094,909 | B2 | 10/2018 | Charvat et al. |
| 2005/0110685 | A1 | 5/2005 | Frederik du Toit |
| 2006/0267844 | A1 | 11/2006 | Yanagi et al. |
| 2008/0316121 | A1 | 12/2008 | Hobson et al. |
| 2014/0203995 | A1 | 7/2014 | Romney et al. |
| 2014/0210486 | A1 | 7/2014 | Dijkstra |
| 2015/0194730 | A1 | 7/2015 | Sudo et al. |
| 2015/0333407 | A1 | 11/2015 | Yamagajo et al. |
| 2017/0256867 | A1 | 9/2017 | Ding et al. |
| 2018/0015920 | A1 | 6/2018 | Baks et al. |
| 2018/0159203 | A1 | 6/2018 | Baks et al. |
| 2018/0198204 | A1 | 7/2018 | Kovacic |

OTHER PUBLICATIONS

Wang, Lei, et al., "Wideband and dual-band high-gain substrate integrated antenna array for E-band multi-gigahertz capacity wireless communication systems", IEEE Transactions on Antennas and Propagation 62.9 (2014): 4602-4611.

Simone Paulotto et al., U.S. Appl. No. 15/650,627, filed Jul. 14, 2017.

Jennifer M. Edwards et al., U.S. Appl. No. 15/950,677, filed Apr. 11, 2018.

ELECTRONIC DEVICE HAVING DUAL-BAND ANTENNAS MOUNTED AGAINST A DIELECTRIC LAYER

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths, but may raise significant challenges. For example, millimeter wave communications signals generated by antennas can be characterized by substantial attenuation and/or distortion during signal propagation through various mediums.

It would therefore be desirable to be able to provide electronic devices with improved wireless communications circuitry such as communications circuitry that supports millimeter and centimeter wave communications.

SUMMARY

An electronic device may be provided with wireless circuitry. The wireless circuitry may include one or more antennas and transceiver circuitry such as centimeter and millimeter wave transceiver circuitry (e.g., circuitry that transmits and receives antennas signals at frequencies greater than 10 GHz). The antennas may be arranged in a phased antenna array.

The electronic device may include a housing having a dielectric cover layer. The phased antenna array may be formed on a dielectric substrate. A surface of the substrate may be mounted against an interior surface of the dielectric cover layer. Each antenna in the phased antenna array may include a first patch element that is directly fed using first and second positive antenna feed terminals and a second patch element that is directly fed using third and fourth positive antenna feed terminals.

A slot element may be formed in the first patch element. The first patch element may radiate first radio-frequency signals in a first frequency band through the dielectric cover layer. The slot element may radiate second radio-frequency signals in a second frequency band that is higher than the first frequency band through the dialectic layer. The second patch element may indirectly feed the slot element using the second radio-frequency signals in the second frequency band. The slot element may be cross-shaped to support polarization diversity in the second frequency band. Locating the radiating element for the first frequency band in the same plane as the radiating element for the second frequency band may allow the antenna to radiate through the dielectric cover layer in both frequency bands with satisfactory antenna efficiency.

DETAILED DESCRIPTION

Figure 1:
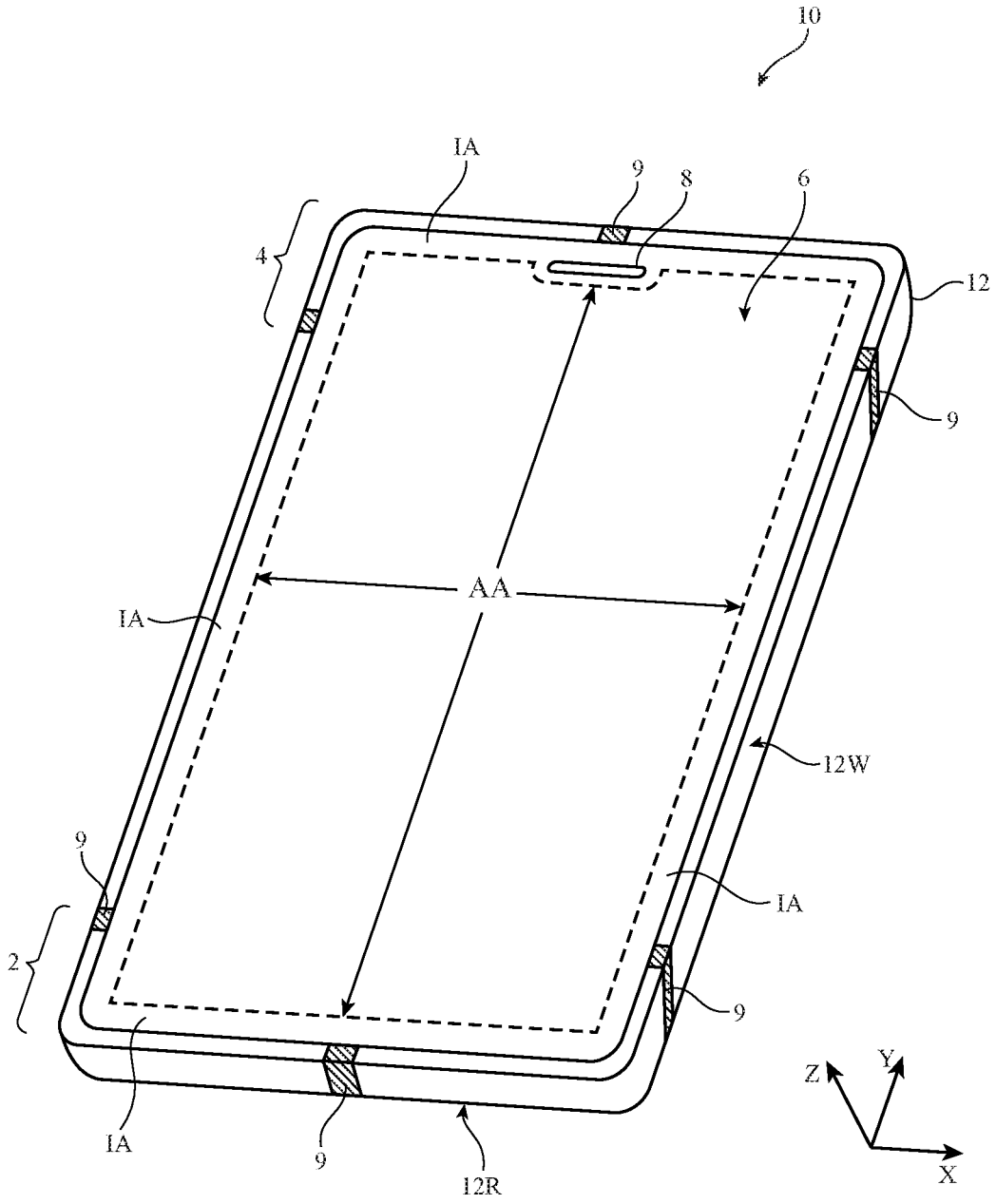
FIG. 1 is a perspective view of an illustrative electronic device in accordance with some embodiments.

Electronic devices such as electronic device 10 of FIG. 1 may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. While uses of millimeter wave communications may be described herein as examples, centimeter wave communications, EHF communications, or any other types of communications may be similarly used. If desired, electronic devices may also contain wireless communications circuitry for handling satellite navigation system signals, cellular telephone signals, local wireless area network signals, near-field communications, light-based wireless communications, or other wireless communications.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 6. Display 6 may be mounted on the front face of device 10. Display 6 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic. Housing 12 may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Peripheral structures 12W and conductive portions of rear housing wall 12R may sometimes be referred to herein collectively as conductive structures of housing 12. Peripheral structures 12W may run around the periphery of device 10 and display 6. In configurations in which device 10 and display 6 have a rectangular shape with four edges, peripheral structures 12W may be implemented using peripheral housing structures that have a rectangular ring shape with four corresponding edges and that extend from rear housing wall 12R to the front face of device 10 (as an example). Peripheral structures 12W or part of peripheral structures 12W may serve as a bezel for display 6 (e.g., a cosmetic trim that surrounds all four sides of display 6 and/or that helps hold display 6 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding lip that helps hold display 6 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 6), peripheral conductive housing structures 12W may run around the lip of housing 12 (i.e., peripheral conductive housing structures 12W may cover only the edge of housing 12 that surrounds display 6 and not the rest of the sidewalls of housing 12).

Rear housing wall 12R may lie in a plane that is parallel to display 6. In configurations for device 10 in which some or all of rear housing wall 12R is formed from metal, it may be desirable to form parts of peripheral conductive housing structures 12W as integral portions of the housing structures forming rear housing wall 12R. For example, rear housing wall 12R of device 10 may include a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Rear housing wall 12R may have one or more, two or more, or three or more portions. Peripheral conductive housing structures 12W and/or conductive portions of rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide peripheral conductive structures 12W and/or conductive portions of rear housing wall 12R from view of the user).

Display 6 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 6 may have an inactive border region that runs along one or more of the edges of active area AA. Inactive area IA may be free of pixels for displaying images and may overlap circuitry and other internal device structures in housing 12. To block these structures from view by a user of device 10, the underside of the display cover layer or other layers in display 6 that overlaps inactive area IA may be coated with an opaque masking layer in inactive area IA. The opaque masking layer may have any suitable color.

Display 6 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 8 or a microphone port. Openings may be formed in housing 12 to form communications ports (e.g., an audio jack port, a digital data port, etc.) and/or audio ports for audio components such as a speaker and/or a microphone if desired.

Display 6 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of peripheral conductive structures 12W). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 6, for example.

In regions 2 and 4, openings may be formed within the conductive structures of device 10 (e.g., between peripheral conductive housing structures 12W and opposing conductive ground structures such as conductive portions of rear housing wall 12R, conductive traces on a printed circuit board, conductive electrical components in display 6, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 2 and 4 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 2 and 4. If desired, the ground plane that is under active area AA of display 6 and/or other metal structures in device 10 may have portions that extend into parts of the ends of device 10 (e.g., the ground may extend towards the dielectric-filled openings in regions 2 and 4), thereby narrowing the slots in regions 2 and 4.

In general, device 10 may include any suitable number of antennas (e.g., one or more, two or more, three or more, four or more, etc.). The antennas in device 10 may be located at opposing first and second ends of an elongated device housing (e.g., ends at regions 2 and 4 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more gaps such as gaps 9, as shown in FIG. 1. The gaps in peripheral conductive housing structures 12W may be filled with dielectric such as polymer, ceramic, glass, air, other dielectric materials, or combinations of these materials. Gaps 9 may divide peripheral conductive housing structures 12W into one or more peripheral conductive segments. There may be, for example, two peripheral conductive segments in peripheral conductive housing structures 12W (e.g., in an arrangement with two of gaps 9), three peripheral conductive segments (e.g., in an arrangement with three of gaps 9), four peripheral conductive segments (e.g., in an arrangement with four of gaps 9), six peripheral conductive segments (e.g., in an arrangement with six gaps 9), etc. The segments of peripheral conductive housing structures 12W that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral conductive housing structures 12W and may form antenna slots, gaps 9, and other structures in device 10. Polymer or other dielectric may fill these grooves and other housing openings. In some situations, housing openings that form antenna slots and other structure may be filled with a dielectric such as air.

In a typical scenario, device 10 may have one or more upper antennas and one or more lower antennas (as an example). An upper antenna may, for example, be formed at the upper end of device 10 in region 4. A lower antenna may, for example, be formed at the lower end of device 10 in region 2. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, etc. Two or more antennas in device 10 may be arranged in a phased antenna array for covering millimeter and centimeter wave communications if desired.

In order to provide an end user of device 10 with as large of a display as possible (e.g., to maximize an area of the device used for displaying media, running applications, etc.), it may be desirable to increase the amount of area at the front face of device 10 that is covered by active area AA of display 6. Increasing the size of active area AA may reduce the size of inactive area IA within device 10. This may reduce the area behind display 6 that is available for antennas within device 10. For example, active area AA of display 6 may include conductive structures that serve to block radio-frequency signals handled by antennas mounted behind active area AA from radiating through the front face of device 10. It would therefore be desirable to be able to provide antennas that occupy a small amount of space within device 10 (e.g., to allow for as large of a display active area AA as possible) while still allowing the antennas to communicate with wireless equipment external to device 10 with satisfactory efficiency bandwidth.

Figure 2:
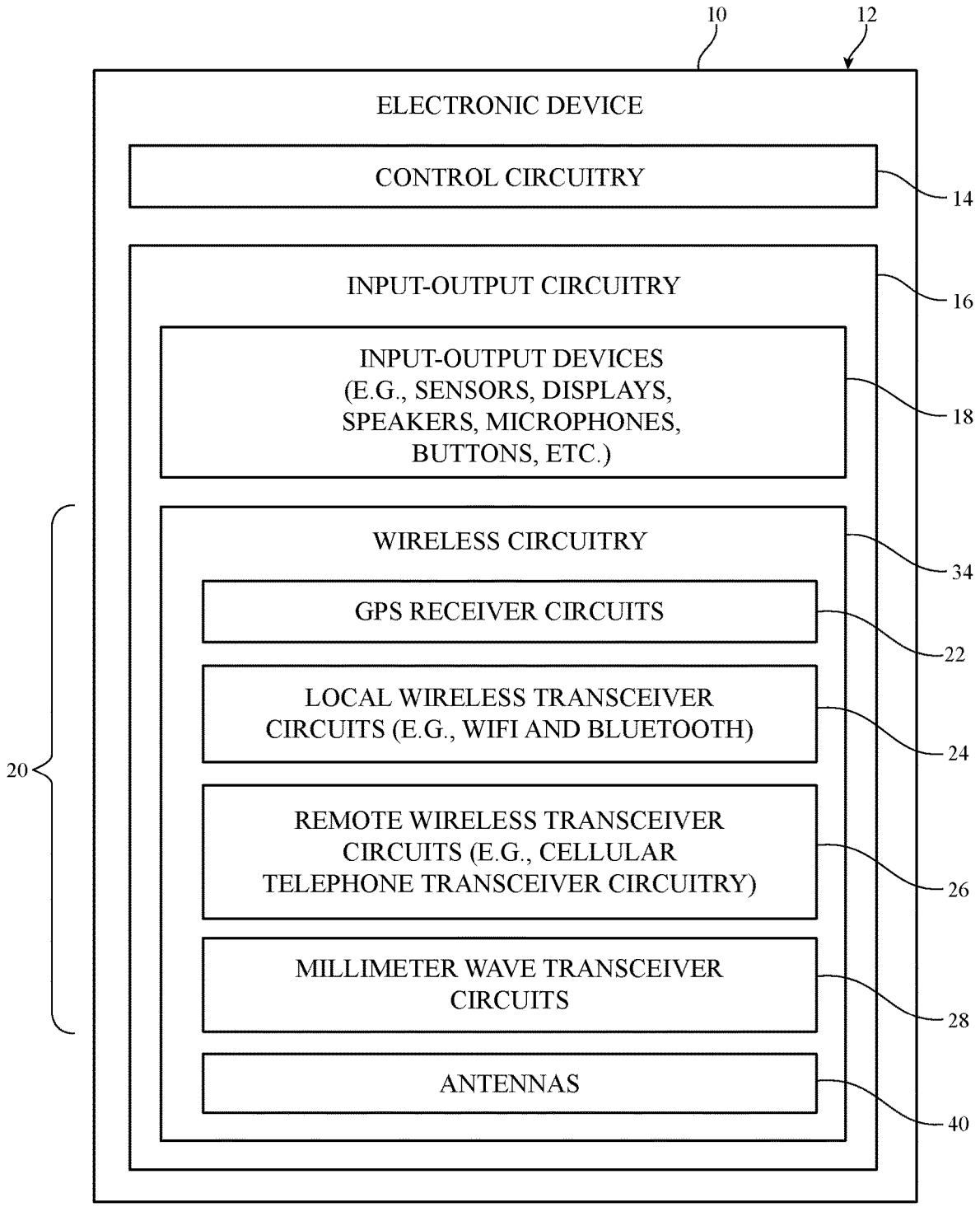
FIG. 2 is a schematic diagram of an illustrative electronic device with wireless communications circuitry in accordance with some embodiments.

FIG. 2 is a schematic diagram showing illustrative components that may be used in an electronic device such as electronic device 10. As shown in FIG. 2, device 10 may include storage and processing circuitry such as control circuitry 14. Control circuitry 14 may include storage such as hard disk drive storage, nonvolatile memory (e.g., flash memory or other electrically-programmable-read-only memory configured to form a solid-state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10 such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, antenna-based spatial ranging protocols (e.g., radio detection and ranging (RADAR) protocols or other desired range detection protocols for signals conveyed at millimeter and centimeter wave frequencies), etc. Each communication protocol may be associated with a corresponding radio access technology (RAT) that specifies the physical connection methodology used in implementing the protocol.

The control circuitry in device 10 (e.g., control circuitry 14) may be configured to perform operations in device 10 using hardware (e.g., dedicated hardware or circuitry), firmware, and/or software. Software code for performing operations in device 10 is stored on non-transitory computer readable storage media (e.g., tangible computer readable storage media) in control circuitry 14. The software code may sometimes be referred to as program instructions, software, data, instructions, or code. The non-transitory computer readable storage media may include non-volatile memory such as non-volatile random-access memory (NVRAM), one or more hard drives (e.g., magnetic drives or solid state drives), one or more removable flash drives or other removable media, etc. Software stored on the non-transitory computer readable storage media may be executed on the processing circuitry of control circuitry 14. The processing circuitry may include application-specific integrated circuits with processing circuitry, one or more microprocessors, a central processing unit (CPU) or other processing circuitry.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry such as wireless circuitry 34 for communicating wirelessly with external equipment. Wireless circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless circuitry 34 may include radio-frequency transceiver circuitry 20 for handling various radio-frequency communications bands. For example, transceiver circuitry 20 may include Global Positioning System (GPS) receiver circuits 22, local wireless transceiver circuits 24, remote wireless transceiver circuits 26, and/or millimeter wave transceiver circuits 28.

Local wireless transceiver circuits 24 may include wireless local area network (WLAN) transceiver circuitry and may therefore sometimes be referred to herein as WLAN transceiver circuitry 24. WLAN transceiver circuitry 24 may handle 2.4 GHz and 5 GHz bands for Wi-Fi® (IEEE 802.11) communications or other wireless local area network (WLAN) bands and may handle the 2.4 GHz Bluetooth® communications band or other wireless personal area network (WPAN) bands.

Remote wireless transceiver circuits 26 may include cellular telephone transceiver circuitry and may therefore sometimes be referred to herein as cellular telephone transceiver circuitry 26. Cellular telephone transceiver circuitry 26 may handle wireless communications in frequency ranges such as a low communications band from 600 to 960 MHz, a midband from 1710 to 2170 MHz, a high band from 2300 to 2700 MHz, an ultra-high band from 3400 to 3700 MHz, or other communications bands between 600 MHz and 4000 MHz or other suitable frequencies (as examples). Cellular telephone transceiver circuitry 26 may handle voice data and non-voice data.

Millimeter wave transceiver circuits 28 (sometimes referred to herein as extremely high frequency (EHF) transceiver circuitry 28 or millimeter wave transceiver circuitry 28) may support communications at frequencies between about 10 GHz and 300 GHz. For example, millimeter wave transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, millimeter wave transceiver circuitry 28 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, millimeter wave transceiver circuitry 28 may support IEEE 802.11ad communications at 60 GHz and/or $5^{th}$ generation mobile networks or $5^{th}$ generation wireless systems (5G) communications bands between 27 GHz and 90 GHz. If desired, millimeter wave transceiver circuitry 28 may support communications at multiple frequency bands between 10 GHz and 300 GHz such as a first band from 24 GHz to 31 GHz, a second band from 37 GHz to 43 GHz, and/or other communications bands between 10 GHz and 300 GHz. Millimeter wave transceiver circuitry 28 may be formed from one or more integrated circuits (e.g., multiple integrated circuits mounted on a common printed circuit in a system-in-package device, one or more integrated circuits mounted on different substrates, etc.).

GPS receiver circuits 22 may receive GPS signals at 1575 MHz or signals for handling other satellite positioning data (e.g., GLONASS signals at 1609 MHz). Satellite navigation system signals for GPS receiver circuits 22 are received from a constellation of satellites orbiting the earth.

In satellite navigation system links, cellular telephone links, and other long-range links, wireless signals are typically used to convey data over thousands of feet or miles. In Wi-Fi® and Bluetooth® links at 2.4 and 5 GHz and other short-range wireless links, wireless signals are typically used to convey data over tens or hundreds of feet. Millimeter wave transceiver circuitry 28 may convey signals that travel (over short distances) between a transmitter and a receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless circuitry 34 can include circuitry for other short-range and long-range wireless links if desired. For example, wireless circuitry 34 may include circuitry for receiving television and radio signals, paging system transceivers, near field communications (NFC) circuitry, etc.

Antennas 40 in wireless circuitry 34 may be formed using any suitable antenna types. For example, antennas 40 may include antennas with resonating elements that are formed from loop antenna structures, patch antenna structures, stacked patch antenna structures, antenna structures having parasitic elements, inverted-F antenna structures, slot antenna structures, planar inverted-F antenna structures, monopoles, dipoles, helical antenna structures, Yagi (Yagi-Uda) antenna structures, surface integrated waveguide structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can be arranged in phased antenna arrays for handling millimeter wave and centimeter wave communications.

Transmission line paths may be used to route antenna signals within device 10. For example, transmission line paths may be used to couple antennas 40 to transceiver circuitry 20. Transmission line paths in device 10 may include coaxial cable paths, microstrip transmission lines, stripline transmission lines, edge-coupled microstrip transmission lines, edge-coupled stripline transmission lines, waveguide structures for conveying signals at millimeter wave frequencies (e.g., coplanar waveguides or grounded coplanar waveguides), transmission lines formed from combinations of transmission lines of these types, etc.

Transmission line paths in device 10 may be integrated into rigid and/or flexible printed circuit boards if desired. In one suitable arrangement, transmission line paths in device 10 may include transmission line conductors (e.g., signal and/or ground conductors) that are integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive). Filter circuitry, switching circuitry, impedance matching circuitry, and other circuitry may be interposed within the transmission lines, if desired.

Device 10 may contain multiple antennas 40. The antennas may be used together or one of the antennas may be switched into use while other antenna(s) are switched out of use. If desired, control circuitry 14 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40 if desired.

In some configurations, antennas 40 may include antenna arrays (e.g., phased antenna arrays to implement beam steering functions). For example, the antennas that are used in handling millimeter and centimeter wave signals for millimeter wave transceiver circuitry 28 may be implemented as phased antenna arrays. The radiating elements in a phased antenna array for supporting millimeter wave communications may be patch antennas, dipole antennas, Yagi (Yagi-Uda) antennas, or other suitable antenna elements. Millimeter wave transceiver circuitry 28 can be integrated with the phased antenna arrays to form integrated phased antenna array and transceiver circuit modules or packages (sometimes referred to herein as integrated antenna modules or antenna modules) if desired.

In devices such as handheld devices, the presence of an external object such as the hand of a user or a table or other surface on which a device is resting has a potential to block wireless signals such as millimeter wave signals. In addition, millimeter wave communications typically require a line of sight between antennas 40 and the antennas on an external device. Accordingly, it may be desirable to incorporate multiple phased antenna arrays into device 10, each of which is placed in a different location within or on device 10. With this type of arrangement, an unblocked phased antenna array may be switched into use and, once switched into use, the phased antenna array may use beam steering to optimize wireless performance. Similarly, if a phased antenna array does not face or have a line of sight to an external device, another phased antenna array that has line of sight to the external device may be switched into use and that phased antenna array may use beam steering to optimize wireless performance. Configurations in which antennas from one or more different locations in device 10 are operated together may also be used (e.g., to form a phased antenna array, etc.).

Figure 3:
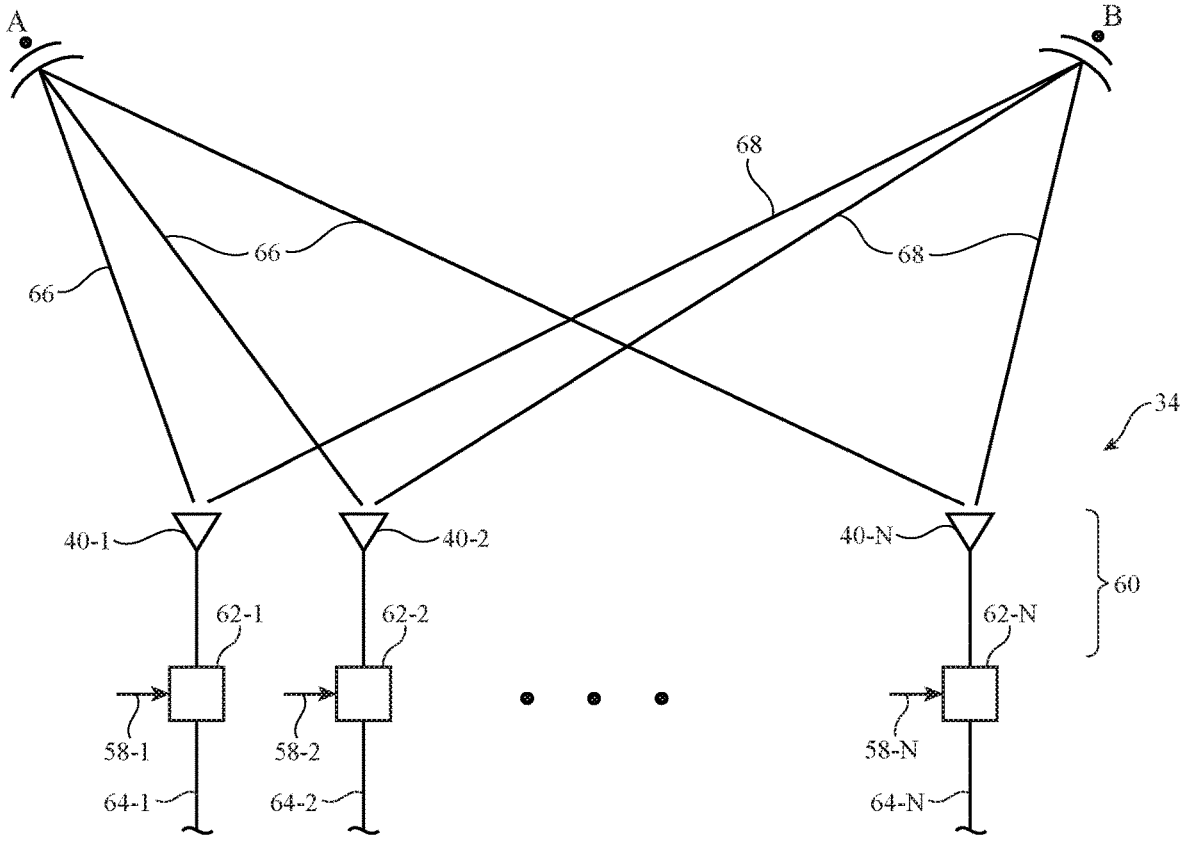
FIG. 3 is a diagram of an illustrative phased antenna array that may be adjusted using control circuitry to direct a beam of signals in accordance with some embodiments.

FIG. 3 shows how antennas 40 on device 10 may be formed in a phased antenna array. As shown in FIG. 3, phased antenna array 60 (sometimes referred to herein as array 60, antenna array 60, or array 60 of antennas 40) may be coupled to signal paths such as transmission line paths 64 (e.g., one or more radio-frequency transmission lines). For example, a first antenna 40-1 in phased antenna array 60 may be coupled to a first transmission line path 64-1, a second antenna 40-2 in phased antenna array 60 may be coupled to a second transmission line path 64-2, an Nth antenna 40-N in phased antenna array 60 may be coupled to an Nth transmission line path 64-N, etc. While antennas 40 are described herein as forming a phased antenna array, the antennas 40 in phased antenna array 60 may sometimes be referred to as collectively forming a single phased array antenna.

Antennas 40 in phased antenna array 60 may be arranged in any desired number of rows and columns or in any other desired pattern (e.g., the antennas need not be arranged in a grid pattern having rows and columns). During signal transmission operations, transmission line paths 64 may be used to supply signals (e.g., radio-frequency signals such as millimeter wave and/or centimeter wave signals) from millimeter wave transceiver circuitry 28 (FIG. 2) to phased antenna array 60 for wireless transmission to external wireless equipment. During signal reception operations, transmission line paths 64 may be used to convey signals received at phased antenna array 60 from external equipment to millimeter wave transceiver circuitry 28 (FIG. 2).

The use of multiple antennas 40 in phased antenna array 60 allows beam steering arrangements to be implemented by controlling the relative phases and magnitudes (amplitudes) of the radio-frequency signals conveyed by the antennas. In the example of FIG. 3, antennas 40 each have a corresponding radio-frequency phase and magnitude controller 62 (e.g., a first phase and magnitude controller 62-1 interposed on transmission line path 64-1 may control phase and magnitude for radio-frequency signals handled by antenna 40-1, a second phase and magnitude controller 62-2 interposed on transmission line path 64-2 may control phase and magnitude for radio-frequency signals handled by antenna 40-2, an Nth phase and magnitude controller 62-N interposed on transmission line path 64-N may control phase and magnitude for radio-frequency signals handled by antenna 40-N, etc.).

Phase and magnitude controllers 62 may each include circuitry for adjusting the phase of the radio-frequency signals on transmission line paths 64 (e.g., phase shifter circuits) and/or circuitry for adjusting the magnitude of the radio-frequency signals on transmission line paths 64 (e.g., power amplifier and/or low noise amplifier circuits). Phase and magnitude controllers 62 may sometimes be referred to collectively herein as beam steering circuitry (e.g., beam steering circuitry that steers the beam of radio-frequency signals transmitted and/or received by phased antenna array 60).

Phase and magnitude controllers 62 may adjust the relative phases and/or magnitudes of the transmitted signals that are provided to each of the antennas in phased antenna array 60 and may adjust the relative phases and/or magnitudes of the received signals that are received by phased antenna array 60 from external equipment. Phase and magnitude controllers 62 may, if desired, include phase detection circuitry for detecting the phases of the received signals that are received by phased antenna array 60 from external equipment. The term "beam" or "signal beam" may be used herein to collectively refer to wireless signals that are transmitted and received by phased antenna array 42 in a particular direction. The signal beam may exhibit a peak gain that is oriented in a particular pointing direction at a corresponding pointing angle (e.g., based on constructive and destructive interference from the combination of signals from each antenna in the phased antenna array). The term "transmit beam" may sometimes be used herein to refer to radio-frequency signals that are transmitted in a particular direction whereas the term "receive beam" may sometimes be used herein to refer to radio-frequency signals that are received from a particular direction.

If, for example, phase and magnitude controllers 62 are adjusted to produce a first set of phases and/or magnitudes for transmitted millimeter wave signals, the transmitted signals will form a millimeter wave frequency transmit beam as shown by beam 66 of FIG. 3 that is oriented in the direction of point A. If, however, phase and magnitude controllers 62 are adjusted to produce a second set of phases and/or magnitudes for the transmitted millimeter wave signals, the transmitted signals will form a millimeter wave frequency transmit beam as shown by beam 68 that is oriented in the direction of point B. Similarly, if phase and magnitude controllers 62 are adjusted to produce the first set of phases and/or magnitudes, wireless signals (e.g., millimeter wave signals in a millimeter wave frequency receive beam) may be received from the direction of point A as shown by beam 66. If phase and magnitude controllers 62 are adjusted to produce the second set of phases and/or magnitudes, signals may be received from the direction of point B, as shown by beam 68.

Each phase and magnitude controller 62 may be controlled to produce a desired phase and/or magnitude based on a corresponding control signal 58 received from control circuitry 14 of FIG. 2 or other control circuitry in device 10 (e.g., the phase and/or magnitude provided by phase and magnitude controller 62-1 may be controlled using control signal 58-1, the phase and/or magnitude provided by phase and magnitude controller 62-2 may be controlled using control signal 58-2, etc.). If desired, control circuitry 14 may actively adjust control signals 58 in real time to steer the transmit or receive beam in different desired directions over time. Phase and magnitude controllers 62 may provide information identifying the phase of received signals to control circuitry 14 if desired.

When performing millimeter or centimeter wave communications, radio-frequency signals are conveyed over a line of sight path between phased antenna array 60 and external equipment. If the external equipment is located at location A of FIG. 3, phase and magnitude controllers 62 may be adjusted to steer the signal beam towards direction A. If the external equipment is located at location B, phase and magnitude controllers 62 may be adjusted to steer the signal beam towards direction B. In the example of FIG. 3, beam steering is shown as being performed over a single degree of freedom for the sake of simplicity (e.g., towards the left and right on the page of FIG. 3). However, in practice, the beam is steered over two or more degrees of freedom (e.g., in three dimensions, into and out of the page and to the left and right on the page of FIG. 3).

Figure 4:
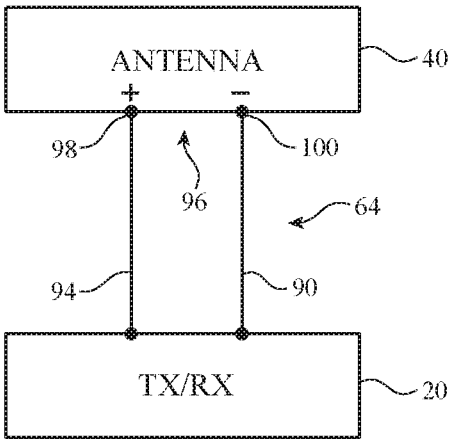
FIG. 4 is a schematic diagram of illustrative wireless communications circuitry in accordance with some embodiments.

A schematic diagram of an antenna 40 that may be formed in phased antenna array 60 (e.g., as antenna 40-1, 40-2, 40-3, and/or 40-N in phased antenna array 60 of FIG. 3) is shown in FIG. 4. As shown in FIG. 4, antenna 40 may be coupled to transceiver circuitry 20 (e.g., millimeter wave transceiver circuitry 28 of FIG. 2). Transceiver circuitry 20 may be coupled to antenna feed 96 of antenna 40 using transmission line path 64 (sometimes referred to herein as radio-frequency transmission line 64). Antenna feed 96 may include a positive antenna feed terminal such as positive antenna feed terminal 98 and may include a ground antenna feed terminal such as ground antenna feed terminal 100. Transmission line path 64 may include a positive signal conductor such as signal conductor 94 that is coupled to terminal 98 and a ground conductor such as ground conductor 90 that is coupled to terminal 100.

Any desired antenna structures may be used for implementing antenna 40. In one suitable arrangement that is sometimes described herein as an example, patch antenna structures may be used for implementing antenna 40. Antennas 40 that are implemented using patch antenna structures may sometimes be referred to herein as patch antennas. An illustrative patch antenna that may be used in phased antenna array 60 of FIG. 3 is shown in FIG. 5.

Figure 5:
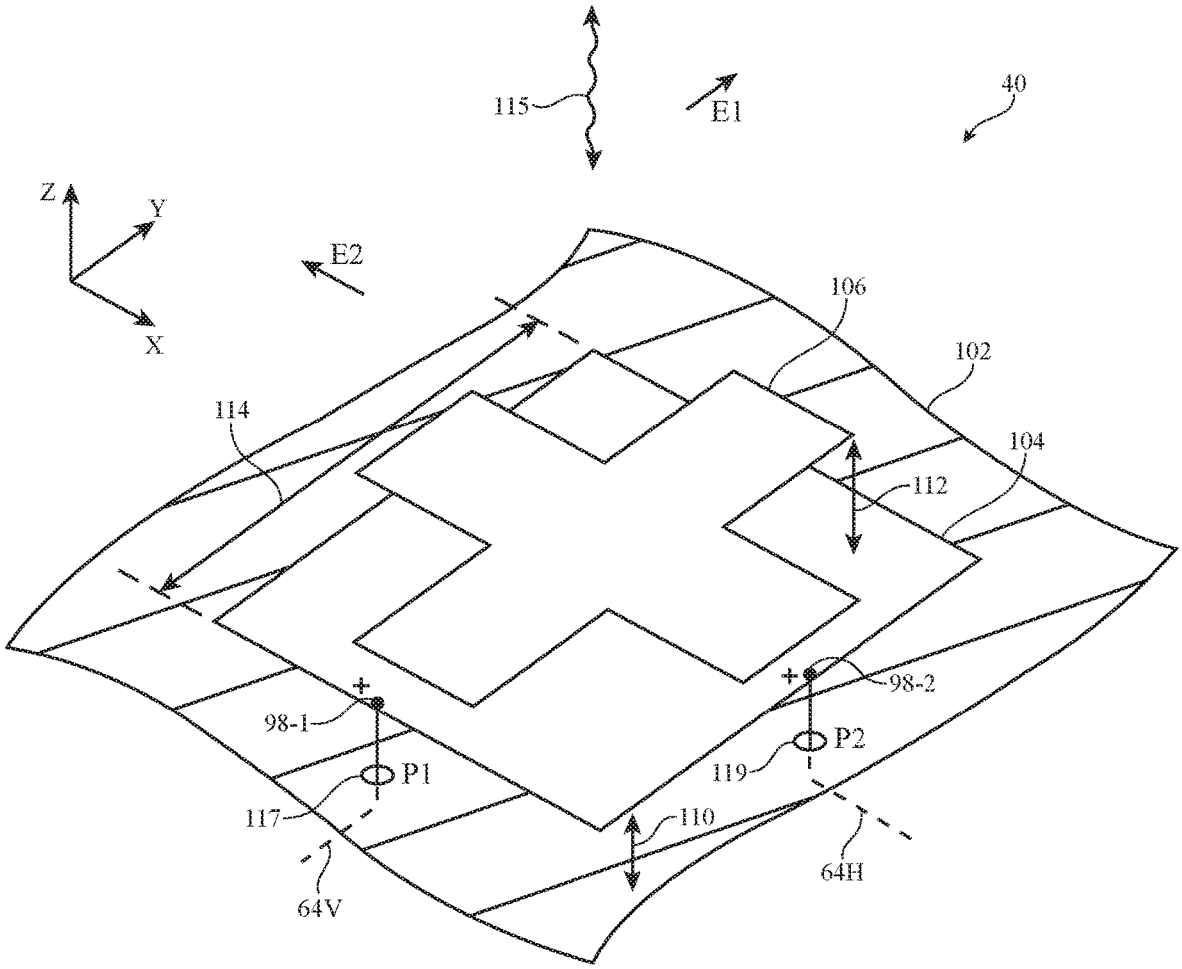
FIG. 5 is a perspective view of an illustrative patch antenna having a parasitic element in accordance with some embodiments.

As shown in FIG. 5, antenna 40 may have a patch antenna resonating element 104 that is separated from and parallel to a ground plane such as antenna ground plane 102 (sometimes referred to herein as antenna ground 102). Patch antenna resonating element 104 may lie within a plane such as the X-Y plane of FIG. 5 (e.g., the lateral surface area of element 104 may lie in the X-Y plane). Patch antenna resonating element 104 may sometimes be referred to herein as patch 104, patch element 104, patch resonating element 104, antenna resonating element 104, or resonating element 104. Ground plane 102 may lie within a plane that is parallel to the plane of patch element 104. Patch element 104 and ground plane 102 may therefore lie in separate parallel planes that are separated by a distance 110. Patch element 104 and ground plane 102 may be formed from conductive traces patterned on a dielectric substrate such as a rigid or flexible printed circuit board substrate, metal foil, stamped sheet metal, electronic device housing structures, or any other desired conductive structures.

The length of the sides of patch element 104 may be selected so that antenna 40 resonates at a desired operating frequency. For example, the sides of patch element 104 may each have a length 114 that is approximately equal to half of the wavelength of the signals conveyed by antenna 40 (e.g., the effective wavelength given the dielectric properties of the materials surrounding patch element 104). In one suitable arrangement, length 114 may be between 0.8 mm and 1.2 mm (e.g., approximately 1.1 mm) for covering a millimeter wave frequency band between 57 GHz and 70 GHz or between 1.6 mm and 2.2 mm (e.g., approximately 1.85 mm) for covering a millimeter wave frequency band between 37 GHz and 41 GHz, as just two examples.

The example of FIG. 5 is merely illustrative. Patch element 104 may have a square shape in which all of the sides of patch element 104 are the same length or may have a different rectangular shape. Patch element 104 may be formed in other shapes having any desired number of straight and/or curved edges. If desired, patch element 104 and ground plane 102 may have different shapes and relative orientations.

To enhance the polarizations handled by antenna 40, antenna 40 may be provided with multiple feeds. As shown in FIG. 5, antenna 40 may have a first feed at antenna port P1 that is coupled to a first transmission line path 64 such as transmission line path 64V and a second feed at antenna port P2 that is coupled to a second transmission line path 64 such as transmission line path 64H. The first antenna feed may have a first ground feed terminal coupled to ground plane 102 (not shown in FIG. 5 for the sake of clarity) and a first positive feed terminal 98-1 coupled to patch element 104. The second antenna feed may have a second ground feed terminal coupled to ground plane 102 (not shown in FIG. 5 for the sake of clarity) and a second positive feed terminal 98-2 on patch element 104.

Holes or openings such as openings 117 and 119 may be formed in ground plane 102. Transmission line path 64V may include a vertical conductor (e.g., a conductive through-via, conductive pin, metal pillar, solder bump, combinations of these, or other vertical conductive interconnect structures) that extends through hole 117 to positive antenna feed terminal 98-1 on patch element 104. Transmission line path 64H may include a vertical conductor that extends through hole 119 to positive antenna feed terminal 98-2 on patch element 104. This example is merely illustrative and, if desired, other transmission line structures may be used (e.g., coaxial cable structures, stripline transmission line structures, etc.).

When using the first antenna feed associated with port P1, antenna 40 may transmit and/or receive radio-frequency signals having a first polarization (e.g., the electric field E1 of antenna signals 115 associated with port P1 may be oriented parallel to the Y-axis in FIG. 5). When using the antenna feed associated with port P2, antenna 40 may transmit and/or receive radio-frequency signals having a second polarization (e.g., the electric field E2 of antenna signals 115 associated with port P2 may be oriented parallel to the X-axis of FIG. 5 so that the polarizations associated with ports P1 and P2 are orthogonal to each other).

One of ports P1 and P2 may be used at a given time so that antenna 40 operates as a single-polarization antenna or both ports may be operated at the same time so that antenna 40 operates with other polarizations (e.g., as a dual-polarization antenna, a circularly-polarized antenna, an elliptically-polarized antenna, etc.). If desired, the active port may be changed over time so that antenna 40 can switch between covering vertical or horizontal polarizations at a given time. Ports P1 and P2 may be coupled to different phase and magnitude controllers 62 (FIG. 3) or may both be coupled to the same phase and magnitude controller 62. If desired, ports P1 and P2 may both be operated with the same phase and magnitude at a given time (e.g., when antenna 40 acts as a dual-polarization antenna). If desired, the phases and magnitudes of radio-frequency signals conveyed over ports P1 and P2 may be controlled separately and varied over time so that antenna 40 exhibits other polarizations (e.g., circular or elliptical polarizations).

If care is not taken, antennas 40 such as dual-polarization patch antennas of the type shown in FIG. 5 may have insufficient bandwidth for covering an entirety of a communications band of interest (e.g., a communications band at frequencies greater than 10 GHz). For example, in scenarios where antenna 40 is configured to cover a millimeter wave communications band between 57 GHz and 71 GHz, patch element 104 as shown in FIG. 5 may have insufficient bandwidth to cover the entirety of the frequency range between 57 GHz and 71 GHz. If desired, antenna 40 may include one or more parasitic antenna resonating elements that serve to broaden the bandwidth of antenna 40.

As shown in FIG. 5, a bandwidth-widening parasitic antenna resonating element such as parasitic antenna resonating element 106 may be formed from conductive structures located at a distance 112 over patch element 104. Parasitic antenna resonating element 106 may sometimes be referred to herein as parasitic resonating element 106, parasitic antenna element 106, parasitic element 106, parasitic patch 106, parasitic conductor 106, parasitic structure 106, parasitic 106, or patch 106. Parasitic element 106 is not directly fed, whereas patch element 104 is directly fed via transmission line paths 64V and 64H and positive antenna feed terminals 98-1 and 98-2. Parasitic element 106 may create a constructive perturbation of the electromagnetic field generated by patch element 104, creating a new resonance for antenna 40. This may serve to broaden the overall bandwidth of antenna 40 (e.g., to cover an entire millimeter wave frequency band from 24 GHz to 31 GHz).

At least some or an entirety of parasitic element 106 may overlap patch element 104. In the example of FIG. 5, parasitic element 106 has a cross or "X" shape. In order to form the cross shape, parasitic element 106 may include notches or slots formed by removing conductive material from the corners of a square or rectangular metal patch. Parasitic element 106 may have a rectangular (e.g., square) outline or footprint. Removing conductive material from parasitic element 106 to form a cross shape may serve to adjust the impedance of patch element 104 so that the impedance of patch element 104 is matched to both transmission line paths 64V and 64H, for example. The example of FIG. 5 is merely illustrative. If desired, parasitic element 106 may have other shapes or orientations.

If desired, antenna 40 of FIG. 5 may be formed on a dielectric substrate (not shown in FIG. 5 for the sake of clarity). The dielectric substrate may be, for example, a rigid or printed circuit board or other dielectric substrate. The dielectric substrate may include multiple stacked dielectric layers (e.g., multiple layers of printed circuit board substrate such as multiple layers of fiberglass-filled epoxy, multiple layers of ceramic substrate, etc.). Ground plane 102, patch element 104, and parasitic element 106 may be formed on different layers of the dielectric substrate if desired.

When configured in this way, antenna 40 may cover a relatively wide millimeter wave communications band of interest such as a frequency band between 24 GHz and 31 GHz. The example of FIG. 5 is merely illustrative. Parasitic element 106 may be omitted if desired. Antenna 40 may have any desired number of feeds. Other antenna types may be used if desired.

Figure 6:
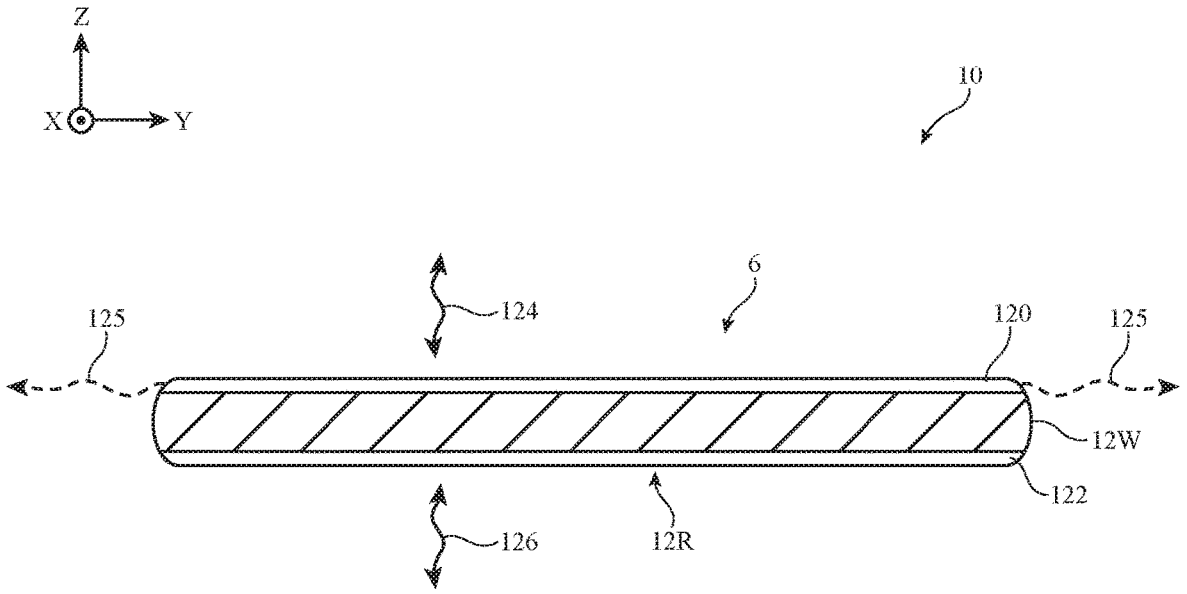
FIG. 6 is a side view of an illustrative electronic device having dielectric cover layers at front and rear faces in accordance with some embodiments.

FIG. 6 is a cross-sectional side view of device 10 showing how phased antenna array 60 (FIG. 3) may convey radio-frequency signals through a dielectric cover layer for device 10. The plane of the page of FIG. 6 may, for example, lie in the Y-Z plane of FIG. 1.

As shown in FIG. 6, peripheral conductive housing structures 12W may extend around the periphery of device 10. Peripheral conductive housing structures 12W may extend across the height (thickness) of device 10 from a first dielectric cover layer such as dielectric cover layer 120 to a second dielectric cover layer such as dielectric cover layer 122. Dielectric cover layers 120 and 122 may sometimes be referred to herein as dielectric covers, dielectric layers, dielectric walls, or dielectric housing walls. If desired, dielectric cover layer 120 may extend across the entire lateral surface area of device 10 and may form a first (front) face of device 10. Dielectric cover layer 122 may extend across the entire lateral surface area of device 10 and may form a second (rear) face of device 10.

In the example of FIG. 6, dielectric cover layer 122 forms a part of rear housing wall 12R for device 10 whereas dielectric cover layer 120 forms a part of display 6 (e.g., a display cover layer for display 6). Active circuitry in display 6 may emit light through dielectric cover layer 120 and may receive touch or force input from a user through dielectric cover layer 120. Dielectric cover layer 122 may form a thin dielectric layer or coating under a conductive portion of rear housing wall 12R (e.g., a conductive backplate or other conductive layer that extends across substantially all of the lateral area of device 10). Dielectric cover layers 120 and 122 may be formed from any desired dielectric materials such as glass, plastic, sapphire, ceramic, etc.

Conductive structures such as peripheral conductive housing structures 12W may block electromagnetic energy conveyed by phased antenna arrays in device 10 such as phased antenna array 60 of FIG. 3. In order to allow radio-frequency signals to be conveyed with wireless equipment external to device 10, phased antenna arrays such as phased antenna array 60 may be mounted behind dielectric cover layer 120 and/or dielectric cover layer 122.

When mounted behind dielectric cover layer 120, phased antenna array 60 may transmit and receive wireless signals (e.g., wireless signals at millimeter and centimeter wave frequencies) such as radio-frequency signals 124 through dielectric cover layer 120. When mounted behind dielectric cover layer 122, phased antenna array 60 may transmit and receive wireless signals such as radio-frequency signals 126 through dielectric cover layer 120.

In practice, radio-frequency signals at millimeter and centimeter wave frequencies such as radio-frequency signals 124 and 126 may be subject to substantial attenuation, particularly through relatively dense mediums such as dielectric cover layers 120 and 122. The radio-frequency signals may also be subject to destructive interference due to reflections within dielectric cover layers 120 and 122 and may generate undesirable surface waves at the interfaces between dielectric cover layers 120 and 122 and the interior of device 10. For example, radio-frequency signals conveyed by a phased antenna array 60 mounted behind dielectric cover layer 120 may generate surface waves at the interior surface of dielectric cover layer 120. If care is not taken, the surface waves may propagate laterally outward (e.g., along the interior surface of dielectric cover layer 120) and may escape out the sides of device 10, as shown by arrows 125. Surface waves such as these may reduce the overall antenna efficiency for the phased antenna array, may generate undesirable interference with external equipment, and may subject the user to undesirable radio-frequency energy absorption, for example. Similar surface waves can also be generated at the interior surface of dielectric cover layer 122.

It may be desirable to cover multiple frequency bands between 10 GHz and 300 GHz using the antennas 40 in phased antenna array 60 (FIG. 3). While a parasitic element such as parasitic element 106 of FIG. 5 may serve to broaden the bandwidth of a given antenna 40, parasitic element 106 may not broaden the bandwidth of antenna 40 enough to cover all desired frequency bands of interest. For example, antenna 40 of FIG. 5 may cover frequencies from 24-31 GHz but may be unable to cover frequencies from 37-43 GHz. In some scenarios, different antennas for covering different frequency bands may be distributed throughout phased antenna array 60. However, space is often at a premium within wireless electronic devices such as device 10. As such, it may be desirable to co-locate radiating elements for covering different frequency bands within the same antenna 40 (sometimes referred to herein as a dual-band antenna or a multi-band antenna).

Figure 7:
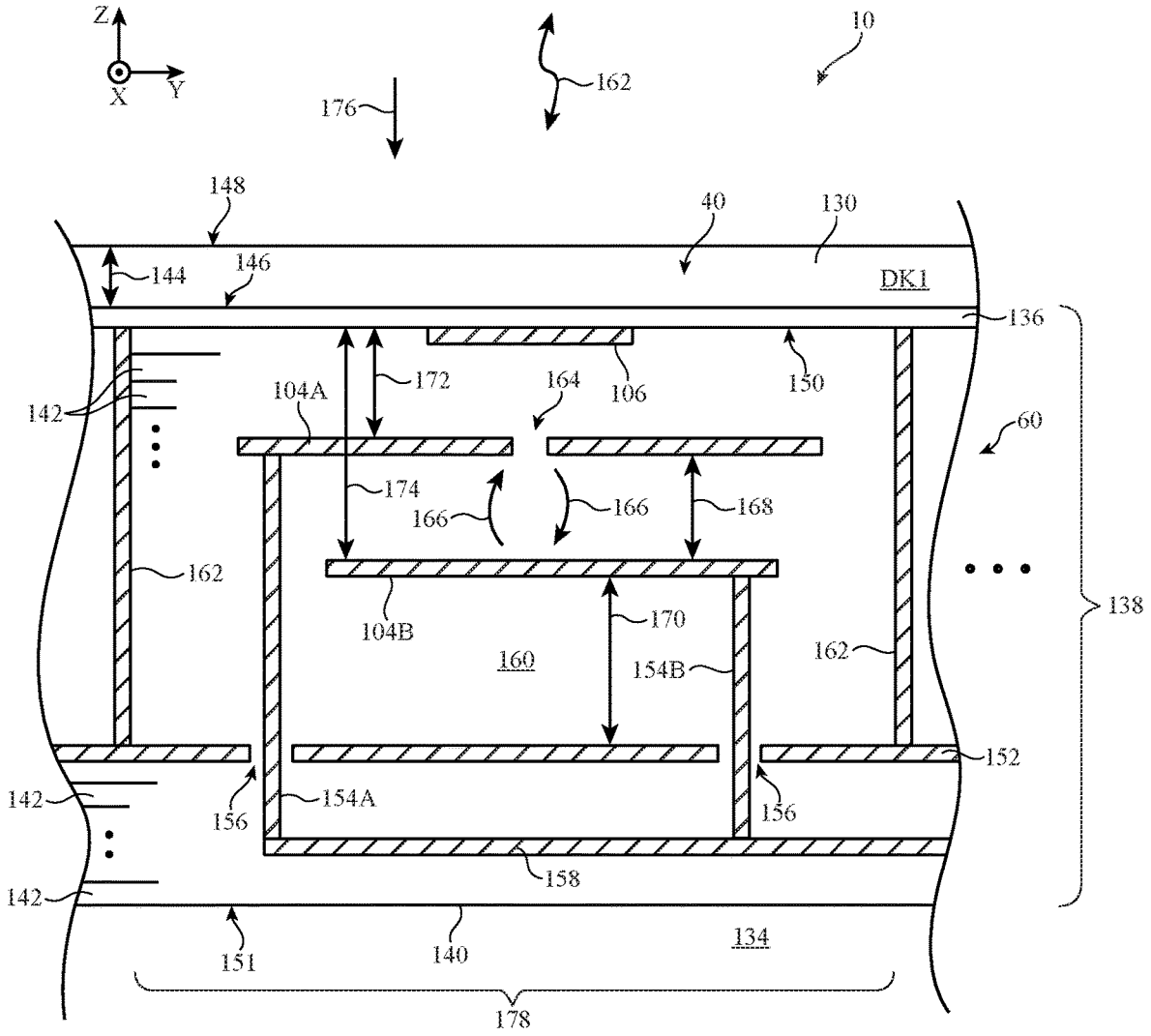
FIG. 7 is a cross-sectional side view of an illustrative dual-band antenna that may be mounted against a dielectric cover layer in an electronic device in accordance with some embodiments.

FIG. 7 is a cross-sectional side view of device 10 showing how a phased antenna array 60 of dual-band antennas may be implemented within device 10. As shown in FIG. 7, phased antenna array 60 may be formed on a dielectric substrate such as substrate 140 mounted within interior 134 of device 10 and against dielectric cover layer 130. Phased antenna array 60 may include multiple antennas 40 arranged in an array of rows and columns (e.g., a one or two-dimensional array). A single antenna 40 is illustrated in FIG. 7 for the sake of clarity. Dielectric cover layer 130 may form a dielectric rear wall for device 10 (e.g., dielectric cover layer 130 of FIG. 7 may form dielectric cover layer 122 of FIG. 6) or may form a display cover layer for device 10 (e.g., dielectric cover layer 130 of FIG. 7 may form dielectric cover layer 120 of FIG. 6), as examples. Dielectric cover layer 130 may be formed from a visually opaque material or may be provided with pigment so that dielectric cover layer 130 is visually opaque if desired.

Substrate 140 may be, for example, a rigid or flexible printed circuit board or other dielectric substrate. Substrate 140 may include multiple stacked dielectric layers 142 (e.g., multiple layers of printed circuit board substrate such as multiple layers of fiberglass-filled epoxy) or may include a single dielectric layer. Substrate 140 may include any desired dielectric materials such as epoxy, plastic, ceramic, glass, foam, or other materials. Antennas 40 in phased array antenna 60 may be mounted at a surface of substrate 140 or may be partially or completely embedded within substrate 140 (e.g., within a single layer of substrate 140 or within multiple layers of substrate 140).

The antennas 40 in phased antenna array 60 may include a ground plane (e.g., ground plane 102 of FIG. 5) and patch elements (e.g., patch element 104 of FIG. 5) that are formed from conductive traces embedded within layers 142 of substrate 140. The ground plane for phased antenna array 60 may be formed from conductive traces 152 within substrate 140. Antennas 40 in phased antenna array 60 may include parasitic elements 106 (e.g., cross-shaped parasitic elements as shown in FIG. 5) that are formed from conductive traces at surface 150 of substrate 140. For example, parasitic elements 106 may be formed from conductive traces on the top-most layer 142 of substrate 140. In another suitable arrangement, one or more layers 142 may be interposed between parasitic elements 106 and dielectric cover layer 130. In yet another suitable arrangement, parasitic elements 106 may be omitted and the patch elements in antennas 40 may be formed from conductive traces at surface 150 of substrate 140 (e.g., the patch elements may be in direct contact with adhesive layer 136 or interior surface 146 of dielectric cover layer 130).

Surface 150 of substrate 140 may be mounted against (e.g., attached to) interior surface 146 of dielectric cover layer 130. For example, substrate 140 may be mounted to dielectric cover layer 130 using an adhesive layer such as adhesive layer 136. This is merely illustrative. If desired, substrate 140 may be affixed to dielectric cover layer 130 using other adhesives, screws, pins, springs, conductive housing structures, etc. Substrate 140 need not be affixed to dielectric cover layer 130 if desired (e.g., substrate 140 may be in direct contact with dielectric cover layer 130 without being affixed to dielectric cover layer 130). Parasitic elements 106 in phased antenna array 60 may be in direct contact with interior surface 146 of dielectric cover layer 130 (e.g., in scenarios where adhesive layer 136 is omitted or where adhesive layer 136 has openings that align with parasitic elements 106) or may be coupled to interior surface 146 by adhesive layer 136 (e.g., parasitic elements 106 may be in direct contact with adhesive layer 136).

Phased antenna array 60 and substrate 140 may sometimes be referred to herein collectively as antenna module 138. If desired, transceiver circuitry (e.g., millimeter wave transceiver circuitry 28 of FIG. 2) and/or other radio-frequency circuitry may be mounted to antenna module 138 (e.g., at surface 151 of substrate 140 or embedded within substrate 140). While FIG. 7 shows only a single antenna 40, this is merely illustrative. In general, any desired number of antennas may be formed in phased antenna array 60.

If desired, a conductive layer (e.g., a conductive portion of rear housing wall 12R when dielectric cover layer 130 forms dielectric cover layer 122 of FIG. 6) may also be formed on interior surface 146 of dielectric cover layer 130. In these scenarios, the conductive layer may provide structural and mechanical support for device 10 and may form a part of the antenna ground plane for device 10. The conductive layer may have an opening that is aligned with phased antenna array 60 and/or antenna module 138 (e.g., to allow radio-frequency signals 162 to be conveyed through the conductive layer).

Conductive traces 152 may sometimes be referred to herein as ground traces 152, ground plane 152, antenna ground 152, or ground plane traces 152. The layers 142 in substrate 140 between ground traces 152 and dielectric cover layer 130 may sometimes be referred to herein as antenna layers. The layers in substrate 140 between ground traces 152 and surface 151 of substrate 140 may sometimes be referred to herein as transmission line layers. The antenna layers may be used to support the patch elements and parasitic elements of the antennas 40 in phased antenna array 60. The transmission line layers may be used to support transmission line paths (e.g., transmission line paths 64V and 64H of FIG. 5) for phased antenna array 60.

Transmission line paths for antennas 40 may be embedded within the transmission line layers of substrate 140. The transmission line paths may include conductive traces 158 within the transmission line layers of substrate 140 (e.g., conductive traces on one or more dielectric layers 142 within substrate 140). Conductive traces 158 may form signal conductor 94 and/or ground conductor 90 (FIG. 4) of one, more than one, or all of the transmission line paths 64 for the antennas 40 in phased antenna array 60. If desired, additional grounded traces within the transmission line layers of substrate 140 and/or portions of ground traces 152 may form ground conductor 90 (FIG. 4) for one or more transmission line paths 64.

Antenna 40 of FIG. 7 is a dual-band antenna that covers two different frequency bands between 10 GHz and 300 GHz. Antenna 40 may include respective patch elements to support communications in each frequency band. As shown in FIG. 7, antenna 40 may include a first patch element 104A and a second patch element 104B that at least partially overlaps patch element 104A. Patch element 104B may be located at a height 170 above ground traces 152. Patch element 104A may be located at height 168 above patch element 104B.

Patch element 104A may be directly fed using one or two antenna feeds having corresponding positive antenna feed terminals coupled to patch element 104A (e.g., positive antenna feed terminals 98-1 and/or 98-2 of FIG. 5). Patch element 104B may also be directly fed using one or two antenna feeds having corresponding positive antenna feed terminals coupled to patch element 104B (e.g., positive antenna feed terminals 98-1 and/or 98-2 of FIG. 5).

Conductive traces 158 may be coupled to the positive antenna feed terminals of patch elements 104A and 104B (e.g., positive antenna feed terminals 98-1 and 98-2 of FIG. 5) over vertical conductive structures (vias) 154. In the example of FIG. 7, a first vertical conductive via 154A is coupled between conductive traces 158 and a positive antenna feed terminal on patch element 104A and a second vertical conductive via 154B is coupled between conductive traces 158 and a positive antenna feed terminal on patch element 104B. Only a single antenna feed and vertical conductive via is shown being coupled to each of patch elements 104A and 104B in FIG. 7 for the sake of clarity. In general, two vertical conductive vias may be used to couple conductive traces 158 to two antenna feeds on each of patch elements 104A and 104B.

Vertical conductive via 154A may extend through a portion of the transmission line layers of substrate 140, a first hole 156 in ground traces 152 (e.g., a hole such as holes 117 and 119 of FIG. 5), and the antenna layers in substrate 140 to patch element 104A. Similarly, Vertical conductive via 154B may extend through a portion of the transmission line layers of substrate 140, a second hole 156 in ground traces 152 (e.g., a hole such as holes 117 and 119 of FIG. 5), and the antenna layers in substrate 140 to patch element 104B. Parasitic element 106 may be provided over patch element 104A for extending the bandwidth of patch element 104B. Patch element 104A, patch element 104B, and parasitic element 106 may each be formed on respective dielectric layers 142 in substrate 140. Zero, one, or more than one dielectric layer 142 may be interposed between the dielectric layer 142 supporting patch element 104B and the dielectric layer 142 supporting patch element 104A. Similarly, zero, one, or more than one dielectric layer 142 may be interposed between the dielectric layer 142 supporting patch element 104A and the dielectric layer 142 supporting parasitic element 106.

Antenna 40 of FIG. 7 may cover a first (lower) frequency band (e.g., a frequency band from 24 GHz to 31 GHz) and a second (higher) frequency band (e.g., a frequency band from 37 GHz to 43 GHz). Patch element 104A may extend across a greater lateral area than patch element 104B to cover the lower frequency band. Patch element 104B may convey radio-frequency signals in the higher frequency band.

If care is not taken, radio-frequency signals transmitted by antenna 40 may reflect off of interior surface 146 of dielectric cover layer 130, thereby limiting the gain of phased antenna array 60 in some directions. Mounting conductive structures from antenna 40 (e.g., patch element 104A or parasitic element 106) directly against interior surface 146 (e.g., either through adhesive layer 136 or in direct contact with interior surface 146) may serve to minimize these reflections, thereby optimizing antenna gain for phased antenna array 60 in all directions. Adhesive layer 136 may have a sufficiently low thickness so as not to contribute to signal reflections while still allowing for a satisfactory adhesion between dielectric cover layer 130 and substrate 140. As an example, the thickness of adhesive layer 136 may be between 300 microns and 400 microns, between 200 microns and 500 microns, between 325 microns and 375 microns, between 100 microns and 600 microns, etc.

In practice, the radio-frequency signals transmitted by phased antenna array 60 may reflect within dielectric cover layer 130 (e.g., at interior surface 146 and/or exterior surface 148 of dielectric cover layer 130). Such reflections may, for example, be due to the difference in dielectric constant between dielectric cover layer 130 and the space external to device 10 as well as the difference in dielectric constant between substrate 140 and dielectric cover layer 130. If care is not taken, the reflected signals may destructively interfere with each other and/or with the transmitted signals within dielectric cover layer 130. This may lead to a deterioration in antenna gain for phased antenna array 60 over some angles, for example.

In order to mitigate these destructive interference effects, the dielectric constant DK1 of dielectric cover layer 130 and thickness 144 of dielectric cover layer 130 may be selected so that dielectric cover layer 130 forms a quarter wave impedance transformer for phased antenna array 60. When configured in this way, dielectric cover layer 130 may optimize matching of the antenna impedance for phased antenna array 60 to the free space impedance external to device 10 and may mitigate destructive interference within dielectric cover layer 130.

As examples, dielectric cover layer 130 may be formed of a material having a dielectric constant between about 3.0 and 10.0 (e.g., between 4.0 and 9.0, between 5.0 and 8.0, between 5.5 and 7.0, between 5.0 and 7.0, etc.). In one particular arrangement, dielectric cover layer 130 may be formed from glass, ceramic, or other dielectric materials having a dielectric constant of about 6.0. Thickness 144 of dielectric cover layer 130 may be selected to be between 0.15 and 0.25 times the effective wavelength of operation (e.g., the lowest or highest wavelength of operation) of phased antenna array 60 in the material used to form dielectric cover layer 130 (e.g., approximately one-quarter of the effective wavelength). The effective wavelength is given by dividing the free space wavelength of operation of phased antenna array 60 (e.g., a centimeter or millimeter wavelength corresponding to a frequency between 10 GHz and 300 GHz) by a constant factor (e.g., the square root of the dielectric constant of the material used to form dielectric cover layer 130). This example is merely illustrative and, if desired, thickness 144 may be selected to be between 0.17 and 0.23 times the effective wavelength, between 0.12 and 0.28 times the effective wavelength, between 0.19 and 0.21 times the effective wavelength, between 0.15 and 0.30 times the effective wavelength, etc. In practice, thickness 144 may be between 0.8 mm and 1.0 mm, between 0.85 mm and 0.95 mm, or between 0.7 mm and 1.1 mm, as examples. Adhesive layer 136 may be formed from dielectric materials having a dielectric constant that is less than dielectric constant DK1 of dielectric cover layer 130.

Each antenna 40 may be separated from the other antennas 40 in phased antenna array 60 by vertical conductive structures such as vertical conductive vias 162 (sometimes referred to herein as conductive vias 162). Sets or fences of conductive vias 162 may laterally surround each antenna 40 in phased antenna array 60. Conductive vias 162 may extend through substrate 140 from surface 141 to ground traces 152. Conductive landing pads (not shown in FIG. 7 for the sake of clarity) may be used to secure conductive vias 162 to each layer 142 as the conductive vias pass through substrate 140. By shorting conductive vias 162 to ground traces 152, conductive vias 162 may be held at the same ground or reference potential as ground traces 152.

As shown in FIG. 7, the patch elements 104A and 104B and the parasitic element 106 of antenna 40 may be mounted within a corresponding volume 160 (sometimes referred to herein as cavity 160). The edges of volume 160 may be defined by conductive vias 162, ground traces 152, and dielectric cover layer 130 (e.g., volume 160 for antenna 40 may be enclosed by conductive vias 162, ground traces 152, and dielectric cover layer 130). In this way, conductive vias 162 and ground traces 152 may form a conductive cavity for each antenna 40 in phased antenna array 60 (e.g., each antenna 40 in phased antenna array 60 may be a cavity-backed dual-band antenna having a conductive cavity formed from conductive vias 162 and ground traces 152).

The conductive cavity formed from ground traces 152 and conductive vias 162 may serve to enhance the gain of each antenna 40 in phased antenna array 60 (e.g., helping to compensate for attenuation and destructive interference associated with the presence of dielectric cover layer 130). Conductive vias 162 may also serve to isolate the antennas 40 in phased antenna array 60 from each other if desired (e.g., to minimize electromagnetic cross-coupling between the antennas).

Each antenna 40 in phased antenna array 60, its corresponding conductive vias 162, its corresponding volume 160, and its corresponding portion of ground traces 152 may sometimes be referred to herein as an antenna unit cell 178. Antenna unit cells 178 in phased antenna array 60 may be arranged in any desired pattern (e.g., a pattern having rows and/or columns or other shapes). Some conductive vias 162 may be shared by adjacent antenna unit cells 178 if desired. Conductive vias 162 may be omitted if desired.

Each antenna 40 in phased antenna array 60 may generate surface waves at interior surface 146 of dielectric cover layer 130 (e.g., surface waves such as surface waves 125 of FIG. 6). However, the lateral placement (tiling) of antenna unit cells 178 at interior surface 146 of dielectric cover layer 130 may configure the surface waves generated by each antenna 40 to destructively interfere and cancel out at the lateral horizon of interior surface 146 (e.g., at relatively far lateral distances from phased antenna array 60 such as at the lateral edges of dielectric cover layer 130). This may prevent the surface waves generated by each antenna 40 in phased antenna array 60 from propagating out of device 10, interfering with external equipment, being absorbed by the user, etc. In this way, phased antenna array 60 may transmit and receive radio-frequency signals 162 at millimeter and centimeter wave frequencies through dielectric cover layer 130 while minimizing reflective losses, destructive interference, and surface wave effects associated with the presence of dielectric cover layer 130.

In practice, these effects may be minimized for radiating elements located at a single fixed distance away from dielectric cover layer 130. For example, thickness 144 and dielectric constant DK1 may be selected to optimize performance of antenna 40 for a radiating element located at distance 172 from dielectric cover layer 130 such as patch element 104A. As examples, distance 172 may be 25-125 microns, 50-150 microns, 10-100 microns, less than 50 microns, greater than 100 microns, etc. However, dielectric cover layer 130 may appear as a substantial impedance discontinuity for radiating elements located at other distances from dielectric cover layer 130 such as patch element 104B located at distance 174 from dielectric cover layer 130. As such, if care is not taken, the radio-frequency signals conveyed by patch element 104B may reflect at the boundaries of dielectric cover layer 130, thereby reducing antenna efficiency for antenna 40 in the higher frequency band covered by patch element 104B.

In order to mitigate these effects, a slot element such as slot element 164 may be provided in patch element 104A. Slot element 164 (sometimes referred to herein as slot 164, gap 164, opening 164, notch 164, slot radiating element 164, or slot resonating element 164) may be configured to radiate radio-frequency signals in the higher frequency band covered by patch element 104B. For example, the perimeter of slot element 164 (e.g., in the X-Y plane) may be selected so that 164 exhibits a resonance in the higher frequency band. Patch element 104B may indirectly feed radio-frequency signals for slot element 164 via near-field electromagnetic coupling 166. Slot element 164 may radiate the indirectly-fed radio-frequency signals through dielectric cover layer 130. Distance 168 between patch element 104A and patch element 104B may be selected to tune the amount of near-field electromagnetic coupling between patch elements 104A and 104B. As an example, distance 168 may be 50-250 microns, 30-300 microns, 100-200 microns, 20-500 microns, or other distances.

Because slot element 164 is located at the same distance 172 from dielectric cover layer 130 as patch element 104A (e.g., since slot element 164 is formed within and has edges defined by patch element 104A), dielectric cover layer 130 may also help to match the impedance of antenna 40 in the higher frequency band to free space (e.g., dielectric cover layer 130 may form a quarter wave transformer at both the lower frequency band handled by patch element 104A and the higher frequency band handled by patch element 104B and slot element 164). Antenna 40 may therefore operate with satisfactory antenna efficiency in both the lower frequency band and the higher frequency band, despite the presence of display cover layer 130. These dual-band antenna structures may be implemented in each antenna or a subset of the antennas across phased antenna array 60.

Figure 8:
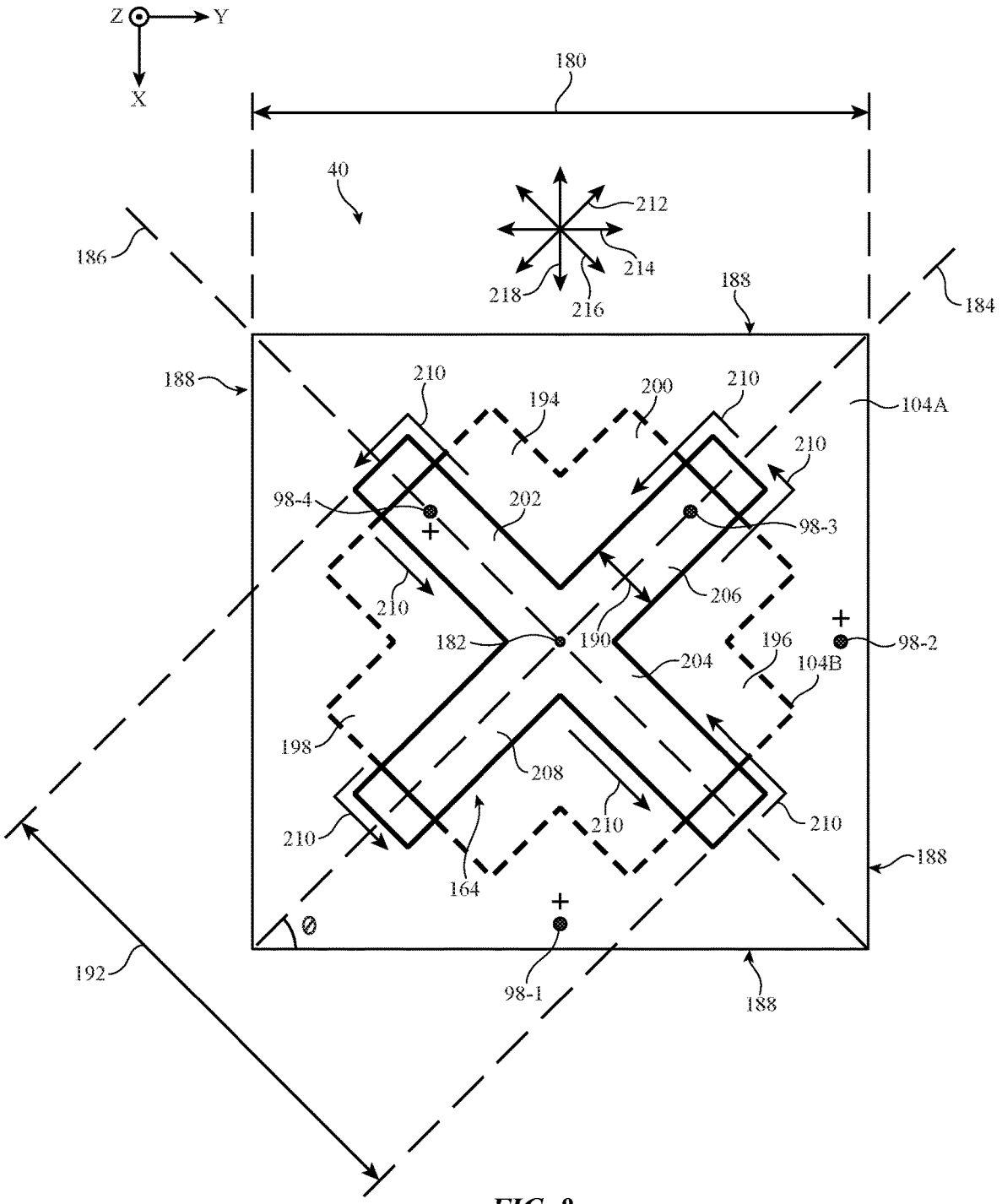
FIG. 8 is a top-down view of an illustrative dual-band antenna that may be mounted against a dielectric cover layer in an electronic device in accordance with some embodiments.

FIG. 8 is a top view of the dual band antenna shown in FIG. 7 (e.g., as taken in the direction of arrow 176 of FIG. 7). In the example of FIG. 8, substrate 80, conductive vias 162, ground traces 152, and dielectric cover layer 130 of FIG. 7 have been omitted for the sake of clarity.

As shown in FIG. 8, patch element 104A may overlap patch element 104B. Patch element 104A may be a rectangular patch having edges 188 extending parallel to the X and Y axes of FIG. 8. Patch element 104A may have a length 180 that configures patch element 104A to radiate in the lower frequency band (e.g., between 24 GHz and 31 GHz). Length 180 may, for example, be one-half of the effective wavelength of operation corresponding to a frequency in the lower frequency band. In practice, length 180 may be 4-6 mm, 2-8 mm, or 4.5-5.5 mm, as examples.

Patch element 104A may be fed using a first positive antenna feed terminal 98-1 and a second positive antenna feed terminal 98-2 (e.g., for covering two linear polarizations or other polarizations). Positive antenna feed terminals 98-1 and 98-2 may each be coupled to conductive transmission line traces over a corresponding vertical conductive via (e.g., vertical conductive vias 154 of FIG. 7). Patch element 104B may be fed using a first positive antenna feed terminal 98-3 and a second positive antenna feed terminal 98-4 (e.g., for covering two linear polarizations or other polarizations). Positive antenna feed terminals 98-3 and 98-4 may each be coupled to conductive transmission line traces over a corresponding vertical conductive via (e.g., vertical conductive vias 154 of FIG. 7).

As shown in FIG. 8, patch element 104A may be rotated at a non-zero angle θ with respect to patch element 104B to maximize isolation between positive antenna feed terminals 98-1/98-2 and positive antenna feed terminals 98-3/98-4. Angle θ may be 30-60 degrees, 40-50 degrees, 45 degrees, or any other non-zero angle. Patch element 104B may be a rectangular (e.g., square) patch or may be a cross-shaped patch. In the example of FIG. 8, patch element 104B is a cross-shaped patch where conductive material from the corners of a square patch have been removed to form arms 194, 200, 196, and 198. Arms 194 and 196 may extend along axis 186. Arms 200 and 198 may extend along axis 184. Axis 186 may meet axis 184 at point 182 (e.g., a point aligned with the center of patch element 104A) and may be orthogonal to axis 184.

Slot element 164 may be formed from a closed slot within patch element 104A (e.g., interior edges of patch element 104A may define the edges of slot element 164 and may therefore laterally surround an entirety of slot element 164). Slot element 164 may be a cross-shaped slot having arms (segments) 202 and 204 extending along axis 186 and arms 208 and 206 extending along axis 184. Arm 202 may overlap positive antenna feed terminal 98-4 on patch element 104B. Arm 206 may overlap positive antenna feed terminal 98-3 on patch element 104B. Each arm of slot element 164 may have width 190. Wider widths 190 may limit the efficiency of antenna 40 (e.g., patch element 104A) in the lower frequency band more than thinner widths 190. At the same time, thinner widths 190 may limit the efficiency of antenna 40 in the higher frequency band. In order to balance antenna efficiency between the lower and higher frequency bands, width 190 may be between one-fifth and one-tenth of the effective wavelength corresponding to a frequency in the higher frequency band (e.g., between 0.1 mm and 0.5 mm, between 0.2 mm and 0.4 mm, etc.).

The length of arms 202, 206, 204, and 208 may configure slot element 164 to radiate in the higher frequency band. For example, slot element 164 may have a length 192 (e.g., measured from the end of arm 202 to the opposing end of arm 204 or from the end of arm 208 to the opposing end of arm 206). Length 192 may be one-half of the effective wavelength of operation of patch element 104B (e.g., the effective wavelength corresponding to a frequency in the higher frequency band). As examples, length 192 may be 1-2 mm, 0.5-2.5 mm, 1.2-1.8 mm, etc. The length of patch element 104B (e.g., measured from the end of arm 194 to the opposing end of arm 196 or from the end of arm 200 to the opposing end of arm 198) may be approximately equal to length 192 (e.g., within 10-20% of length 192, equal to length 192, etc.).

When configured in this way, patch element 104B may resonate in the higher frequency band. This resonance may indirectly feed slot element 164 via near-field electromagnetic coupling, inducing antenna current to flow around the edges of slot element 164, as shown by arrows 210. Antenna current 210 may produce corresponding radio-frequency signals that are radiated through the dielectric cover layer of device 10 (e.g., dielectric cover layer 130 of FIG. 7). Similarly, antenna current 210 may be produced by radio-frequency signals received through the dielectric cover layer of device 10. The antenna current associated with slot element 164 (e.g., the antenna current generated by positive antenna feed terminals 98-4 and 98-3 on patch element 104B) may be sufficiently isolated from the antenna current generated by positive antenna feed terminals 98-1 and 98-2 on patch element 104A, which generally follows the exterior edges 188 of patch element 104A.

When configured in this way, antenna 40 may radiate through the dielectric cover layer with satisfactory antenna efficiency in both the lower and higher frequency bands because the radiating element for handling the higher frequency band (e.g., slot element 164) and the radiating element for handling the lower frequency band (e.g., patch element 104A) are both located in the same plane. Antenna 40 may also support polarization diversity in both frequency bands when configured in this way. For example, positive antenna feed terminal 98-1 may convey radio-frequency signals in the lower frequency band at a first linear polarization, as shown by arrows 218, whereas positive antenna feed terminal 98-2 conveys radio-frequency signals in the lower frequency band at a second (orthogonal) linear polarization, as shown by arrows 214. Similarly, positive antenna feed terminal 98-3 may convey radio-frequency signals in the higher frequency band at a third linear polarization, as shown by arrows 212, whereas positive antenna feed terminal 98-4 conveys radio-frequency signals in the higher frequency band at a fourth (orthogonal) linear polarization, as shown by orthogonal arrows 216 (e.g., slot element 164 may preserve the polarizations of patch element 104B).

If desired, a parasitic element (e.g., parasitic element 106 of FIG. 7) may be centered at point 182 and overlapping patch element 104A. The parasitic element may be a cross-shaped parasitic element having arms extending parallel to the X and Y axes of FIG. 8. The parasitic element may have a length of 0.8-1.2 mm and a width of 0.05-0.15 mm, as just one example.

The example of FIG. 8 is merely illustrative. In general, slot element 164 and patch element 104B may be oriented at any desired non-zero angle θ relative to patch element 104A. Patch element 104A, patch element 104B, and slot element 164 may have any other desired shapes (e.g., shapes having straight and/or curved edges) and relative orientations.

Figure 9:
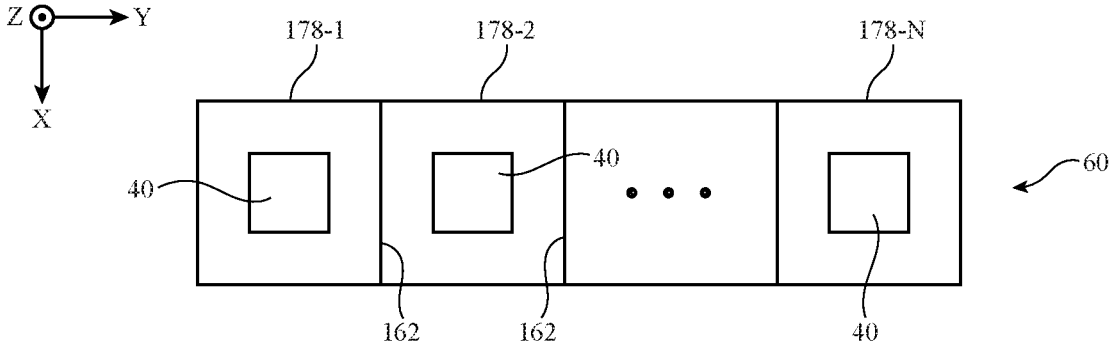
FIGS. 9 and 10 are top-down views showing how multiple dual-band antennas of the type shown in FIGS. 7 and 8 may be arranged in a phased antenna array in accordance with some embodiments.

FIG. 9 is a top-down view showing how multiple unit cells 178 may be used to form a 1-by-N phased antenna array 60 of antennas 40 (e.g., dual-band antennas 40 of the type shown in FIGS. 7 and 8). As show in FIG. 9, N unit cells 178 (e.g., a first unit cell 178-1, a second unit cell 178-2, an Nth unit cell 178-N, etc.) may be arranged in a single row. Each unit cell 178 may include a corresponding antenna 40. Phased antenna array 60 of FIG. 9 may perform beam scanning along a single axis (e.g., parallel to the Y-axis of FIG. 9). Each of the antennas 40 in phased antenna array 60 may be embedded within the same substrate (e.g., substrate 140 of FIG. 7). Conductive walls (e.g., fences of conductive vias 162) may separate and electromagnetically isolate adjacent unit cells 178. Conductive vias 162 may be omitted if desired.

Figure 10:
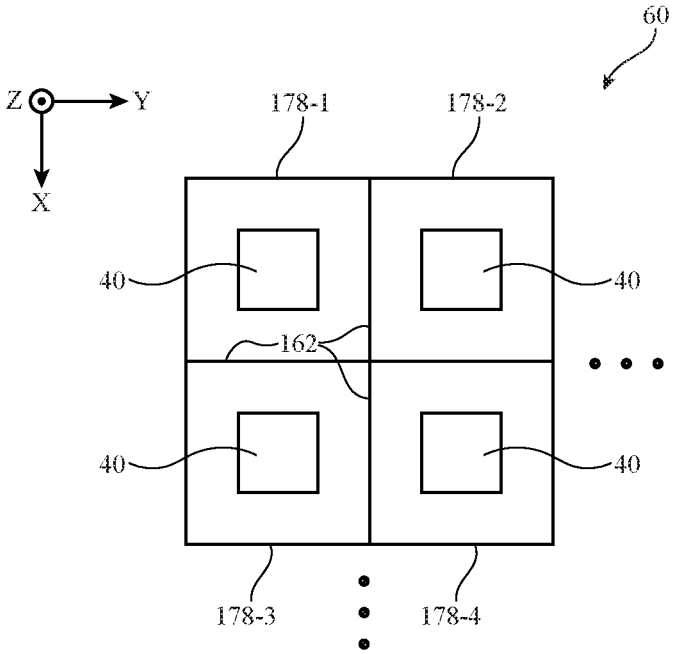

The example of FIG. 9 is merely illustrative. In general, unit cells 178 may be arranged in other patterns (e.g., rectangular patterns having N columns and M rows, non-rectangular patterns, etc.). FIG. 10 shows an example in which four or more unit cells 178 (e.g., antenna unit cells 178-1, 178-2, 178-3, and 178-4) are arranged in a rectangular pattern having multiple rows and columns. Two-dimensional phased antenna arrays such as phased antenna array 60 of FIG. 10 may perform beam steering in two dimensions (e.g., parallel to the X and Y axes across a hemisphere over phased antenna array 60).

Figure 11:
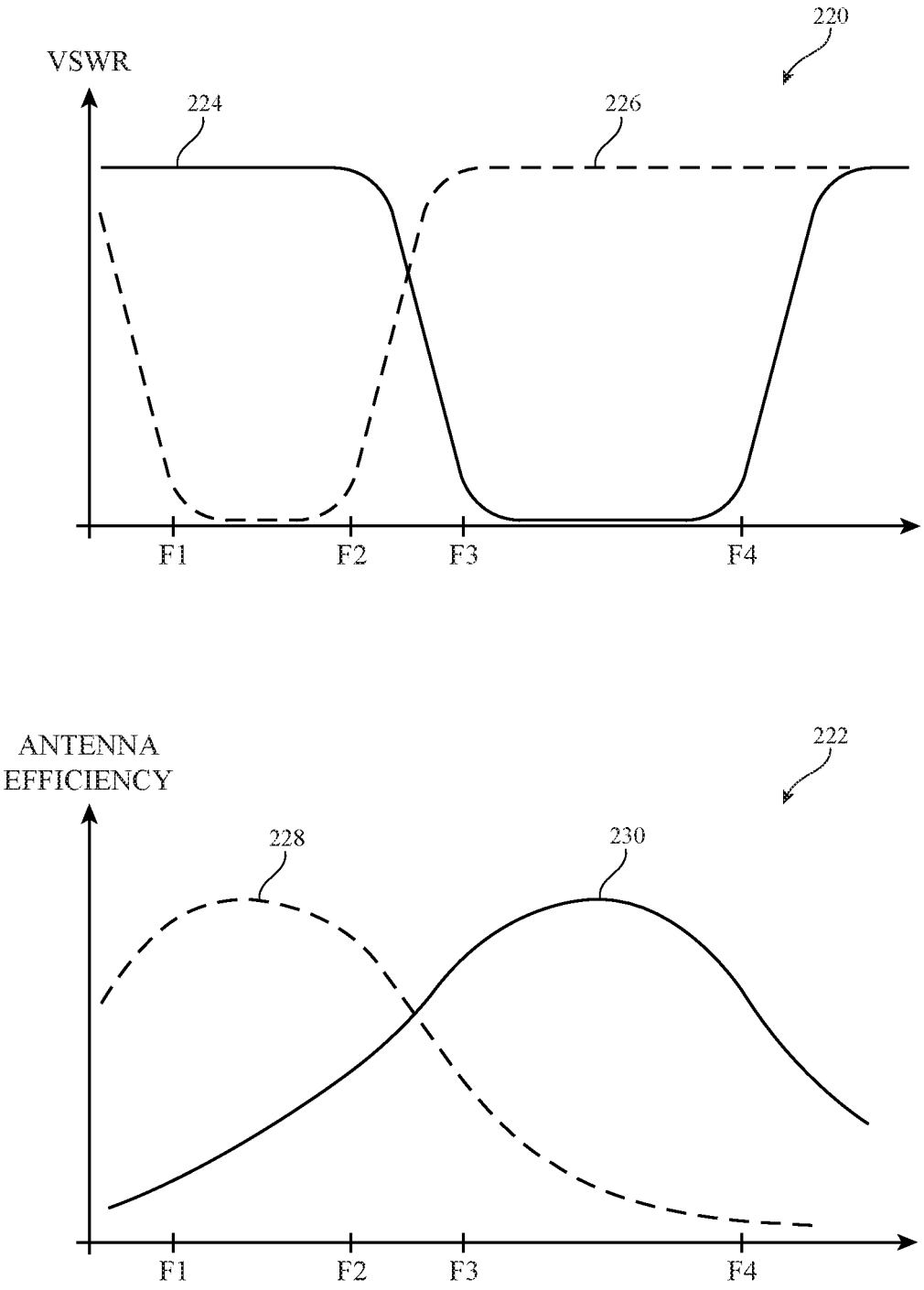
FIG. 11 shows illustrative plots of antenna performance (standing wave ratio and antenna efficiency) as a function of frequency for a dual-band antenna of the type shown in FIGS. 7-10 in accordance with some embodiments.

FIG. 11 shows illustrative plots of antenna performance for dual-band antennas such as antenna 40 of FIGS. 7-10. As shown in FIG. 11, graph 220 plots standing wave ratio as a function of frequency for antenna 40 of FIGS. 7-10. Curve 224 of graph 220 illustrates the standing wave ratio of slot element 164 (e.g., for radio-frequency signals conveyed by positive antenna feed terminals 98-3 and 98-4 of FIG. 8). As shown by curve 224, slot element 164 exhibits a response peak in a higher frequency band between frequencies F3 and F4. Curve 226 of graph 220 illustrates the standing wave ratio of patch element 104A (e.g., for radio-frequency signals conveyed by positive antenna feed terminals 98-1 and 98-2 of FIG. 8). As shown by curve 226, patch element 104A exhibits a response peak in a lower frequency band between frequencies F1 and F2. Antenna 40 may collectively exhibit the responses of both curves 224 and 226 to cover both the lower and higher frequency bands. As an example, frequency F1 may be 24 GHz, frequency F2 may be 31 GHz, frequency F3 may be 37 GHz, and frequency F4 may be 43 GHz. This is merely illustrative and, in general, frequencies F1 through F4 may be any desired frequencies between 10 GHz and 300 GHz.

Graph 222 plots antenna efficiency as a function of frequency for antenna 40. Curve 230 of graph 222 illustrates the antenna efficiency of antenna 40 due to the resonance of slot element 164. As shown by curve 224, slot element 164 exhibits a peak efficiency in the higher frequency band between frequencies F3 and F4. Curve 228 of graph 222 illustrates the antenna efficiency for antenna 40 due to the resonance of patch element 104A. As shown by curve 228, patch element 104A exhibits a peak efficiency in the lower frequency band between frequencies F1 and F2. Antenna 40 may collectively exhibit an antenna efficiency that includes the efficiency peaks from both curves 228 and 230 to cover both the lower and higher frequency bands. In this way, antenna 40 may cover both first and second millimeter and/or centimeter wave frequency bands with satisfactory antenna efficiency and while preserving polarization diversity, despite the inclusion of different radiators occupying the same volume (e.g., volume 160 of FIG. 7) and the presence of a dielectric cover layer (e.g., dielectric cover layer 130 of FIG. 7).

The foregoing is merely illustrative and various modifications can be made to the described embodiments. The foregoing embodiments may be implemented individually or in any combination.

What is claimed is:

1. An antenna comprising:

a patch element;

first and second positive antenna feed terminals coupled to the patch element, wherein the patch element is configured to radiate in a first frequency band higher than 10 GHz; and a slot element in the patch element, wherein the slot element is configured to radiate in a second frequency band higher than the first frequency band.

2. The antenna defined in claim 1, further comprising:

a ground plane; and an additional patch element interposed between the ground plane and the patch element, wherein the additional patch element is configured to indirectly feed the slot element via near-field electromagnetic coupling.

3. The antenna defined in claim 2, further comprising: third and fourth positive antenna feed terminals coupled to the additional patch element.

4. The antenna defined in claim 3, wherein the additional patch element is rotated at a non-zero angle with respect to the patch element.

5. The antenna defined in claim 4, wherein the non-zero angle is between 30 and 60 degrees.

6. The antenna defined in claim 3, wherein the slot element comprises a first arm overlapping the third positive antenna feed terminal and a second arm overlapping the fourth positive antenna feed terminal.

7. The antenna defined in claim 6, wherein the first arm extends perpendicular to the second arm.

8. The antenna defined in claim 3, further comprising:

a dielectric substrate having transmission line layers;

first, second, third, and fourth conductive vias extending through the dielectric substrate from the transmission line layers to the first, second, third, and fourth positive antenna feed terminals, respectively.

9. The antenna defined in 8, further comprising:

fences of additional conductive vias that extend from the ground plane through the substrate and that laterally surround the patch element and the additional patch element.

10. The antenna defined in claim 1, wherein the slot element comprises arms that extend along first and second orthogonal axes, the patch element has edges, and the first and second orthogonal axes are oriented at a non-zero angle with respect to each of the edges of the patch element.

11. The antenna defined in claim 1, wherein the patch element is configured to convey radio-frequency signals in the first frequency band with first and second orthogonal polarizations and the slot element is configured to convey radio-frequency signals in the second frequency band with third and fourth orthogonal polarizations that are oriented at a non-zero angle with respect to the first and second orthogonal polarizations.

12. The antenna defined in claim 1, wherein the first frequency band comprises frequencies between 24 GHz and 31 GHz and the second frequency band comprises frequencies between 37 GHz and 43 GHz.

13. An electronic device comprising:

a dielectric cover layer;

a dielectric substrate having a surface that is mounted against the dielectric cover layer; and an antenna having first and second patch elements embedded within the dielectric substrate, wherein a slot element is formed in the first patch element, the first patch element is configured to convey radio-frequency signals in a first frequency band greater than 10 GHz through the dielectric cover layer, the second patch element is configured to indirectly feed the slot element using radio-frequency signals in a second frequency band, and the slot element is configured to convey the radio-frequency signals in the second frequency band through the dielectric cover layer.

14. The electronic device defined in claim 13, The electronic device defined in claim 13, wherein the electronic device has opposing first and second faces and further comprises:

a display having a display cover layer and pixel circuitry that emits light through the display cover layer, wherein the display cover layer forms the first face of the electronic device and the dielectric cover layer forms the second face of the electronic device.

15. The electronic device defined in claim 13, further comprising:

a display having pixel circuitry, wherein the pixel circuitry is configured to emit light through the dielectric cover layer.

16. The electronic device defined in claim 13, further comprising:

a parasitic element on the dielectric substrate and interposed between the first patch element and the dielectric cover layer.

17. The electronic device defined in claim 13, wherein the slot element comprises a closed slot that is completely surrounded by conductive material from the first patch element.

18. The electronic device defined in claim 13, wherein the second frequency band is higher than the first frequency band.

19. The electronic device defined in claim 13, wherein the first patch element is directly fed using first and second positive antenna feed terminals, the second patch element being directly fed using third and fourth positive antenna feed terminals.

20. An electronic device comprising:

a dielectric layer;

a phased antenna array mounted against the dielectric layer, wherein the phased antenna array is configured to convey first radio-frequency signals in a first frequency band and second radio-frequency signals in a second frequency band through the dielectric layer, the first and second frequency bands each comprising frequencies greater than 10 GHz, and the phased antenna array comprising:

a first radiating element that is located at a distance from the dielectric layer and that is configured to convey the first radio-frequency signals through the dielectric layer; and a second radiating element that is located at the distance from the dielectric layer, that is laterally surrounded by the first radiating element, and that is configured to convey the second radio-frequency signals through the dielectric layer.

* * * * *